US008028932B2

(12) United States Patent
Sesser et al.

(10) Patent No.: US 8,028,932 B2
(45) Date of Patent: Oct. 4, 2011

(54) SPRINKLER WITH NUTATING MECHANISM AND OPTIONAL WEIGHT

(75) Inventors: George L. Sesser, Walla Walla, WA (US); Craig B. Nelson, Walla Walla, WA (US)

(73) Assignee: Nelson Irrigation Corporation, Walla Walla, WA (US)

( * ) Notice: Subject to any disclaimer, the term of this patent is extended or adjusted under 35 U.S.C. 154(b) by 280 days.

(21) Appl. No.: 12/416,558

(22) Filed: Apr. 1, 2009

(65) Prior Publication Data

US 2010/0252654 A1 Oct. 7, 2010

(51) Int. Cl.
*B05B 3/04* (2006.01)

(52) U.S. Cl. ..... 239/222.21; 239/222.11; 239/222.17; 239/231; 239/524

(58) Field of Classification Search ..... 239/222.11, 239/222.17, 222.21, 231, 237, 518, 524
See application file for complete search history.

(56) References Cited

U.S. PATENT DOCUMENTS

| | | | | |
|---|---|---|---|---|
| 2,848,276 | A | 8/1958 | Clearman | |
| 3,034,728 | A | 5/1962 | Hruby, Jr. | |
| 3,532,273 | A | 10/1970 | Siddai et al. | |
| 3,958,643 | A | 5/1976 | Landsberg | |
| 3,964,685 | A | 6/1976 | Chauvigne | |
| 4,073,438 | A | 2/1978 | Meyer | |
| 4,487,368 | A | 12/1984 | Clearman | |
| 5,381,960 | A | 1/1995 | Sullivan et al. | |
| 5,439,174 | A | 8/1995 | Sweet | |
| 5,588,595 | A | 12/1996 | Sweet et al. | |
| 5,671,885 | A | 9/1997 | Davisson | |
| 5,950,927 | A | 9/1999 | Elliott et al. | |
| 6,092,739 | A * | 7/2000 | Clearman et al. | 239/237 |
| 6,176,440 | B1 | 1/2001 | Elliott | |
| 6,267,299 | B1 | 7/2001 | Meyer | |
| 6,360,965 | B1 * | 3/2002 | Clearman et al. | 239/222.11 |
| 6,382,525 | B1 | 5/2002 | Santiesteban et al. | |
| 6,439,477 | B1 | 8/2002 | Sweet et al. | |
| 6,530,532 | B1 | 3/2003 | Santiesteban et al. | |
| 6,932,279 | B2 | 8/2005 | Burcham | |
| 7,287,710 | B1 | 10/2007 | Nelson et al. | |
| 7,395,977 | B2 | 7/2008 | Pinch et al. | |

OTHER PUBLICATIONS

U.S. Appl. No. 12/222,740, filed Aug. 14, 2008 (Pending).

* cited by examiner

*Primary Examiner* — Steven J Ganey
(74) *Attorney, Agent, or Firm* — Nixon & Vanderhye, P.C.

(57) ABSTRACT

A rotary, nutating sprinkler head includes a housing supporting a nozzle; a starter tube axially adjacent the nozzle and extending in a downstream direction, concentric with a vertical center axis of the sprinkler head. A spool assembly is loosely supported on the starter tube, the spool assembly including a double-flanged spool and a water-deflection plate carried by the spool, the water-deflection plate formed with one or more grooves shaped to cause the spool assembly to rotate when impinged upon by a stream emitted from the nozzle. Either the starter tube or the spool is provided with at least one tilting lug located to keep the spool assembly in a tilted or angularly offset orientation relative to the vertical center axis, thereby facilitating a wobbling action of the spool assembly during rotation.

19 Claims, 12 Drawing Sheets

SPRINKLER WITH NUTATING MECHANISM AND OPTIONAL WEIGHT

BACKGROUND OF THE INVENTION

This invention relates to rotary sprinkler heads and, more particularly, to sprinkler heads that nutate (i.e., wobble while they rotate) to minimize the "donut effect" prevalent with conventional rotary sprinkler heads.

Conventional rotary sprinklers typically throw one or more streams in a radial direction to wet a specified area in a circular pattern. In circumstances where the sprinkler is in a fixed location, unless some mechanism is employed to break up the one or more streams, a donut pattern is created that leaves a substantial dry area inside the pattern. A higher speed of rotation tends to break down the stream or streams, but also shortens the stream's throw-radius. An alternative is the wobbling-type sprinkler where a water-deflection plate is caused to wobble as it rotates (sometimes referred to as a nutating action). Various nutating or wobbling sprinkler head designs have been available but with potential shortcomings that can nullify the very effect that makes such sprinklers attractive in the first instance. Examples of known nutating or wobbling sprinkler heads may be found in U.S. Pat. Nos. 5,381,960; 5,950,927; and 6,932,279. Commonly owned U.S. Pat. Nos. 5,439,174; 5,588,595; 5,671,885; 6,267,299; and 6,439,477 provide further examples.

A problem often encountered with sprinklers of this type relates to stalling, primarily at start-up, but possibly also during normal operation. Stalling occurs when the water-deflection plate of the sprinkler head fails to tilt at start-up, or ceases tilting during operation, thereby simply rotating (without wobbling) and distributing a stream particularly susceptible to the donut effect. When nutating or wobbling sprinklers operate as designed, the wobbling action tends to fill in the pattern in a substantially uniform manner. Thus, it is critical that the water-deflection plate reliably and consistently remain in a tilted orientation on start-up and while rotating to achieve the desired wobbling action.

Another issue relating to wobbling-type sprinklers is excessive wear on the engaged wobbling/rotating and stationary surfaces. This issue is addressed in applicants, copending application Ser. No. 12/222,740 filed Aug. 14, 2008.

There remains a need, however, for establishing even greater wear life for the sprinkler components, while also enabling reliable "tipping" of the wobbling assembly on start-up.

BRIEF SUMMARY OF THE INVENTION

In one exemplary but nonlimiting embodiment, a sprinkler head includes a housing supporting a nozzle and a spool assembly. The spool assembly is made up of a double-flanged spool and a water-deflection (or distribution) plate carried by the spool, downstream of the nozzle. The spool assembly is loosely supported on a hanger tube coaxially aligned with, and extending downstream of the nozzle. Mechanical elements such as lugs are located on a ring flange on a lower portion of the spool for maintaining the spool assembly in a tilted or axially offset orientation relative to a longitudinal center axis through the sprinkler head. An annular race is supported within the housing and is adapted to be engaged by surfaces of upper and lower flanges of the spool during rotation of the spool assembly. The "running surfaces" of the spool engage the annular race mainly via rolling contact (with only minimal sliding contact) to thereby improve the wear life of the components.

An optional weight can be attached to the sprinkler head housing for stability, utilizing cooperable surface features enabling quick attachment and detachment of the weight. For example, the weight may be attached by threaded engagement that tends to tighten due to vibration under normal operating conditions.

Thus, in accordance with one nonlimiting aspect of the invention, there is provided a rotary, nutating sprinkler head comprising a housing supporting a nozzle; a tube axially adjacent the nozzle and extending in a downstream direction, concentric with a vertical center axis of the sprinkler head; a spool having a hub and upper and lower flanges, the spool loosely supported on the tube, said spool carrying a water-deflection plate formed with one or more grooves shaped to cause the spool and the water-deflection plate to rotate when the waters deflection plate is impinged upon by a stream emitted from the nozzle, the upper flange having an underside formed with a radially outer concave lip, and the lower flange having a topside formed with a first annular array of teeth facing the upper flange; an annular race supported in the housing, having a radially inner surface defining a center opening; an upper surface having a substantially smooth, radially inner surface portion engageable with the radially outer concave lip of the upper flange, and a lower side having a surface portion formed with a second annular array of teeth engageable with the first annular array of teeth as the spool rotates and wobbles about the center axis.

In another nonlimiting aspect, the invention relates to a rotary, nutating sprinkler head comprising a housing supporting a nozzle; a tube axially adjacent the nozzle and extending in a downstream direction, concentric with a vertical center axis of the sprinkler head; a double-flanged spool loosely supported on the tube, the spool carrying a water-deflection plate, the water-deflection plate formed with one or more grooves shaped to cause the spool to rotate when impinged upon by a stream emitted from the nozzle; and an annular race supported in the housing having upper and lower surfaces engageable via substantially rolling contact with portions of the upper and lower flanges, respectively, of the spool as the spool rotates and wobbles about the center axis.

In still another nonlimiting aspect, the invention relates to a race for use in a wobbling sprinkler head comprising an annular ring having upper and lower surfaces and radially inner and outer edges, the radially inner edge defining a center opening, the upper surface formed with an upwardly convex rib having an apex; and the lower surface formed with an annular array of teeth adjacent the center opening and angularly-oriented in a circumferential direction.

The exemplary embodiments of the invention will now be described in detail in connection with the drawings identified below.

DETAILED DESCRIPTION OF THE DRAWINGS

Figure 1:
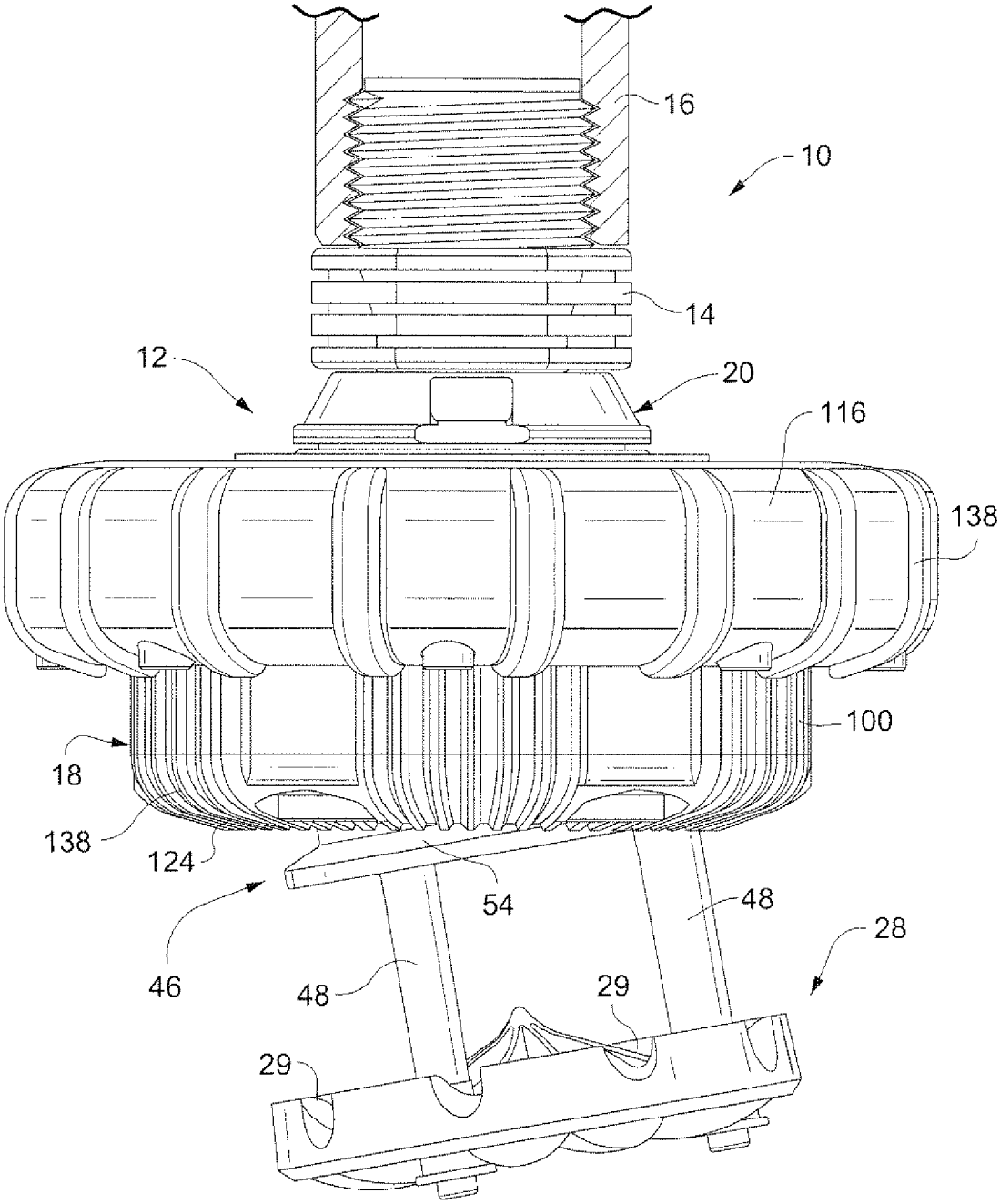
FIG. 1 is a front elevation of a sprinkler head in accordance with a first exemplary but nonlimiting embodiment, with an optional weight attached.
Figure 2:
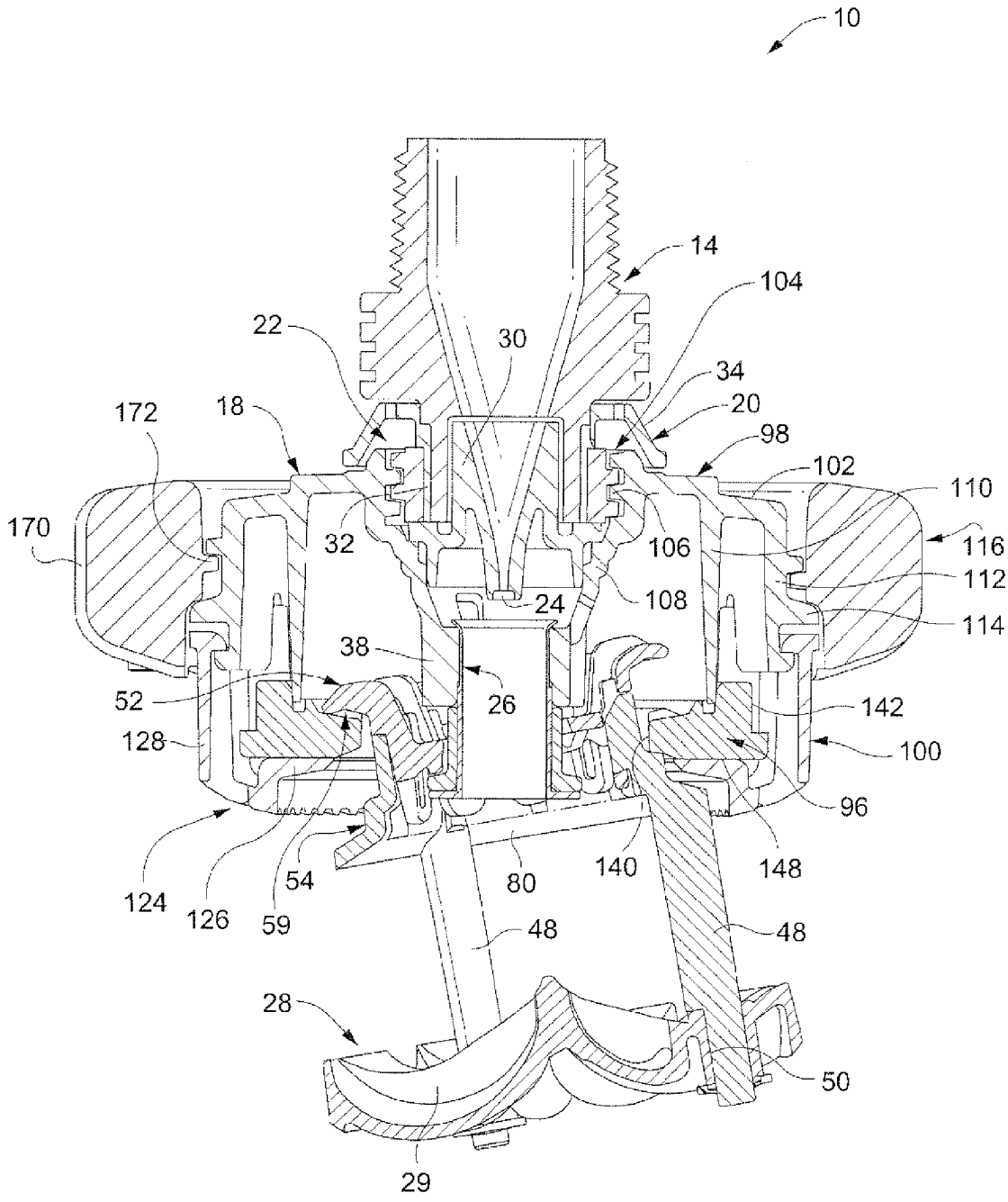
FIG. 2 is a cross section taken along the longitudinal center axis of the sprinkler head in FIG. 1, with the water-deflection plate shown in an operative mode.
Figure 3:
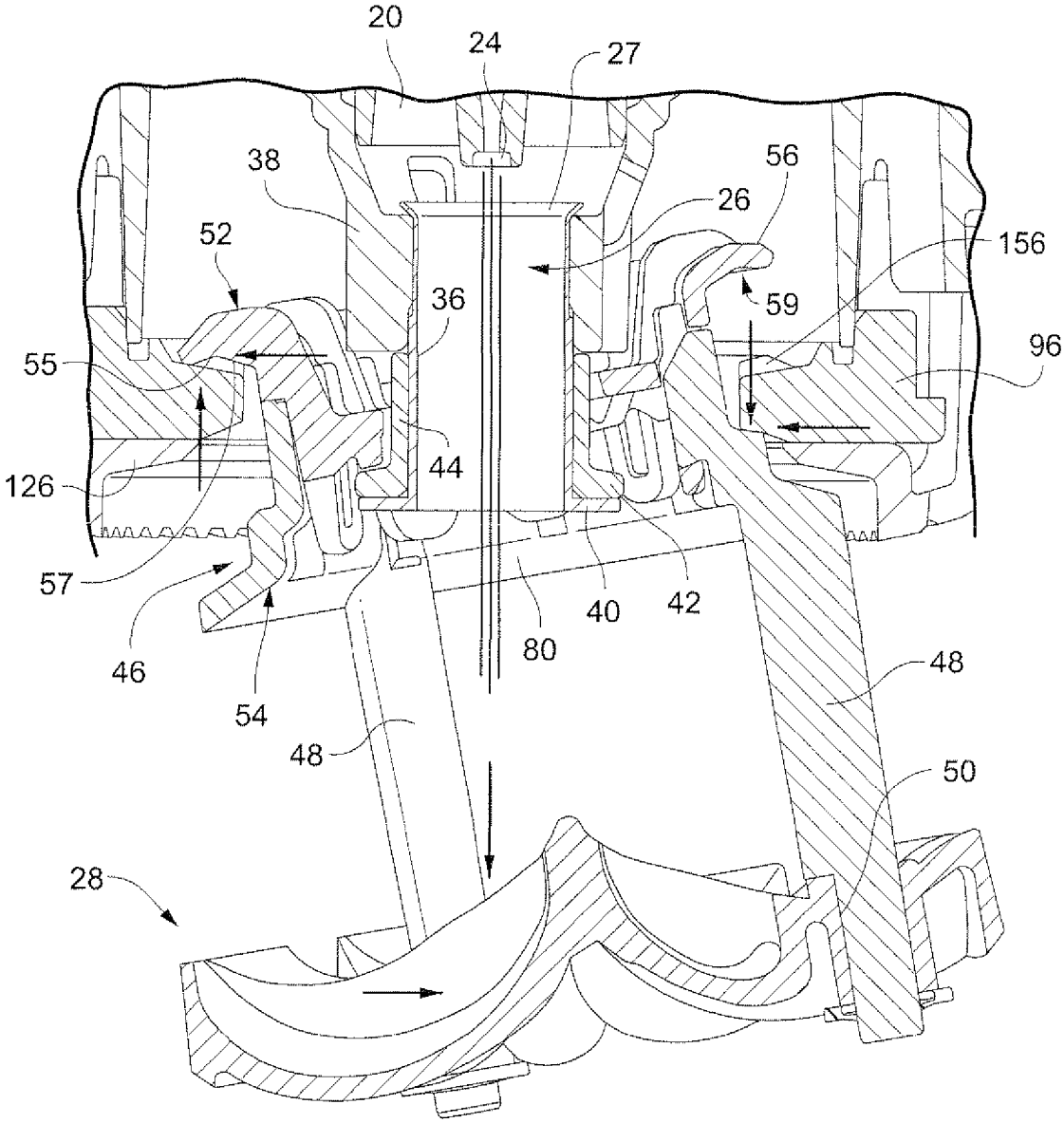
FIG. 3 is an enlarged detail taken from FIG. 2 but also showing the direction of forces on the spool, race and water-deflection plate during use.

With initial reference to FIGS. 1-3, a sprinkler head 10 includes a sprinkler body assembly 12 which includes an adaptor 14 for securing the sprinkler head to a flexible conduit, fixed riser or other irrigation component 16 (partially shown in FIG. 1 only); a sprinkler housing assembly 18, and a nozzle body 20. Unless otherwise specified, the various components are constructed of a hard plastic material, but other suitable materials may be employed.

As best appreciated from FIG. 2, the nozzle body 20 is sandwiched between the adaptor 14 and the sprinkler housing assembly 18 which are secured together via a threaded connection at 22. The nozzle body 20 per se is of known construction, formed with an orifice 24 that emits a solid stream of water that passes through an axially adjacent hanger tube (or, simply, "tube") 26 to atmosphere, and toward a water-distribution or water-deflection plate 28, as described further hereinbelow. Thus, water flowing through the nozzle body 20 will exit the orifice 24 and then flow through the tube 26 and strike the water-deflection plate 28. The water-deflection plate 28 is provided with plural grooves 29, some or all which are curved in a circumferential direction to cause the plate to rotate when impinged upon by a stream emitted from the nozzle.

The nozzle body 20 is formed with an inner tapered portion 30 that terminates in a downstream direction at the orifice 24. A radially outer tubular portion 32 extends in an upstream direction to a conical ring flange 34 that is visible to the user, and that may have nozzle size and/or performance information thereon. It will be appreciated that the nozzle body 20 is easily removed and replaced by the same or different-size nozzle, simply by unscrewing the adaptor 14 and lifting the nozzle.

As best seen in FIG. 3, the hanger tube 26 is formed with a substantially cylindrical tubular portion 36 that is press fit into an inner tubular portion or hub 38 of the sprinkler housing assembly 18, and fixed (e.g., staked) at its upstream end 27. The downstream end of the hanger tube 26 is formed with an outwardly directed radial flange 40 on which is seated a flange 42 of an otherwise substantially cylindrical starter sleeve 44 that is telescoped over the hanger tube prior to its attachment to the hub 38.

As described further below, a double-flanged spool assembly (or "spool assembly") 46 and the water-deflection plate 28 are carried by the starter sleeve 44 and hanger tube 26 for wobbling or nutating motion. More specifically, the water-deflection plate 28 is carried by the spool assembly 46 via three circumferentially-spaced struts 48 (see also FIG. 6). The struts 48 may be formed integrally with the spool and extend through apertures 50 formed in the water-deflection plate 28. The water-deflection plate may be attached to the struts 48 by screws or other fasteners such as lock-washers, or by means of, for example, heat and pressure applied to the tips of the struts, i.e., by heat staking.

Figure 4:
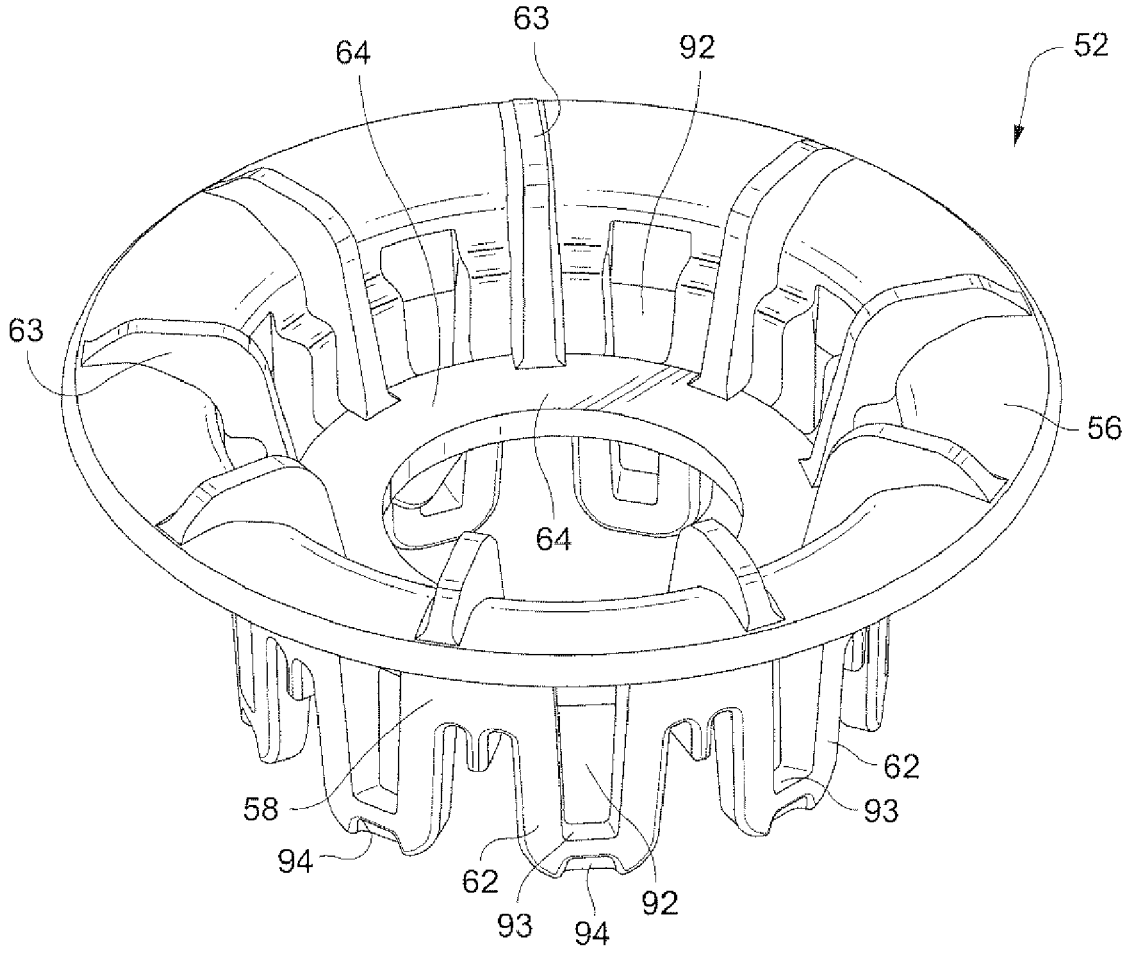
FIG. 4 is an upper perspective view of an upper part of the spool component removed from FIGS. 1 and 2.
Figure 5:
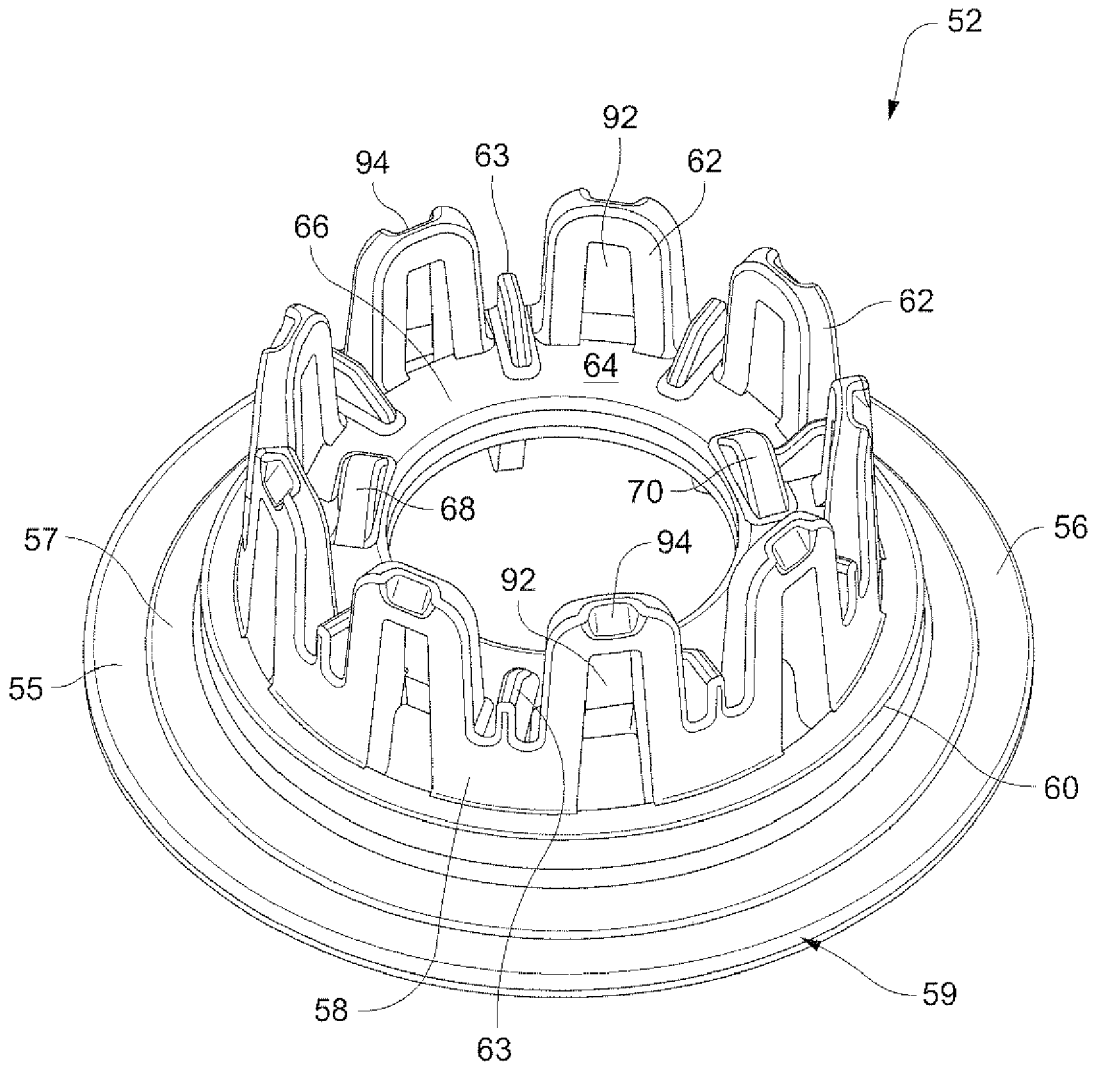
FIG. 5 is a lower perspective view of the upper part of the spool component shown in FIG. 4.
Figure 6:
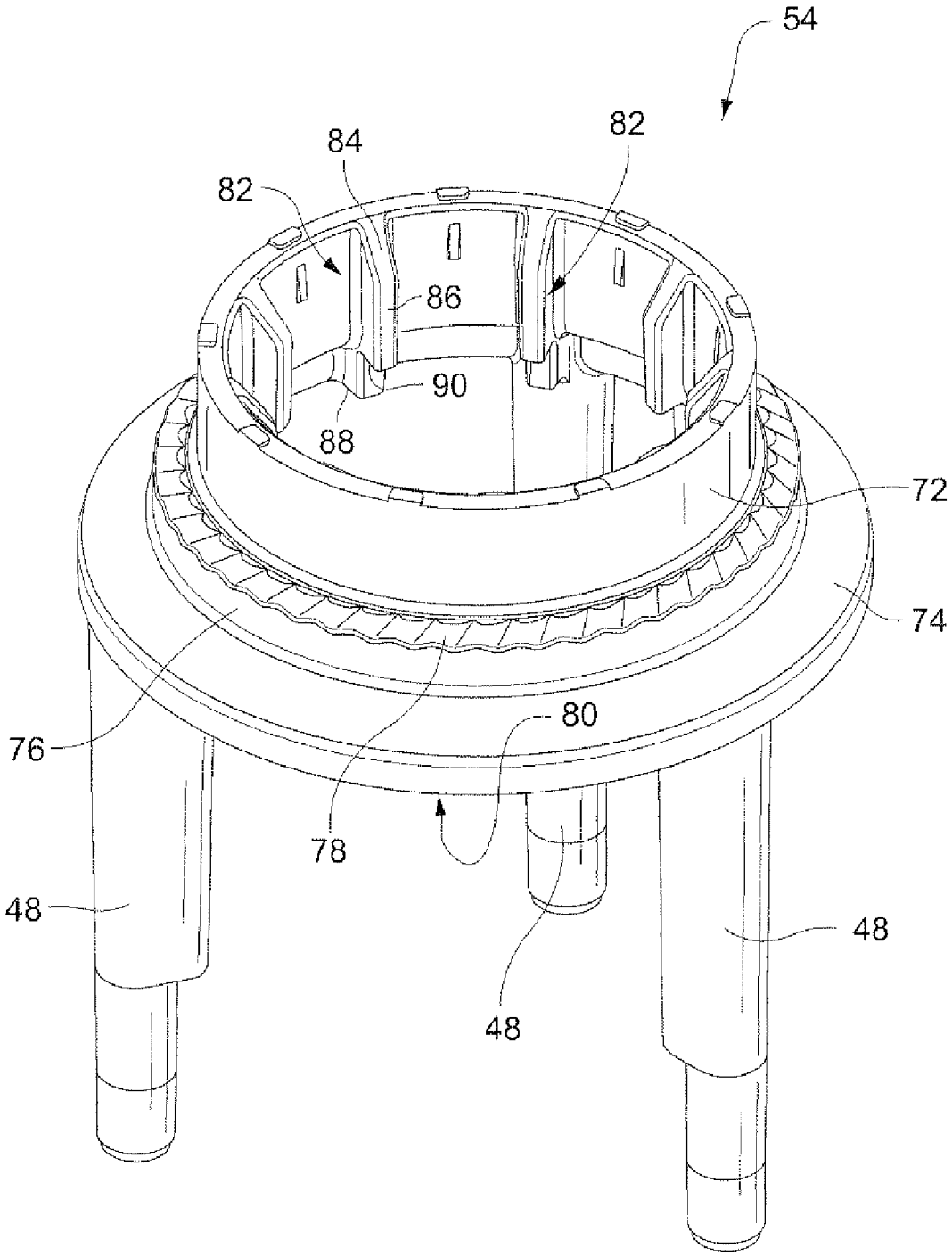
FIG. 6 is an upper perspective view of a lower part of the spool component removed from the sprinkler head shown in FIGS. 1 and 2.
Figure 7:
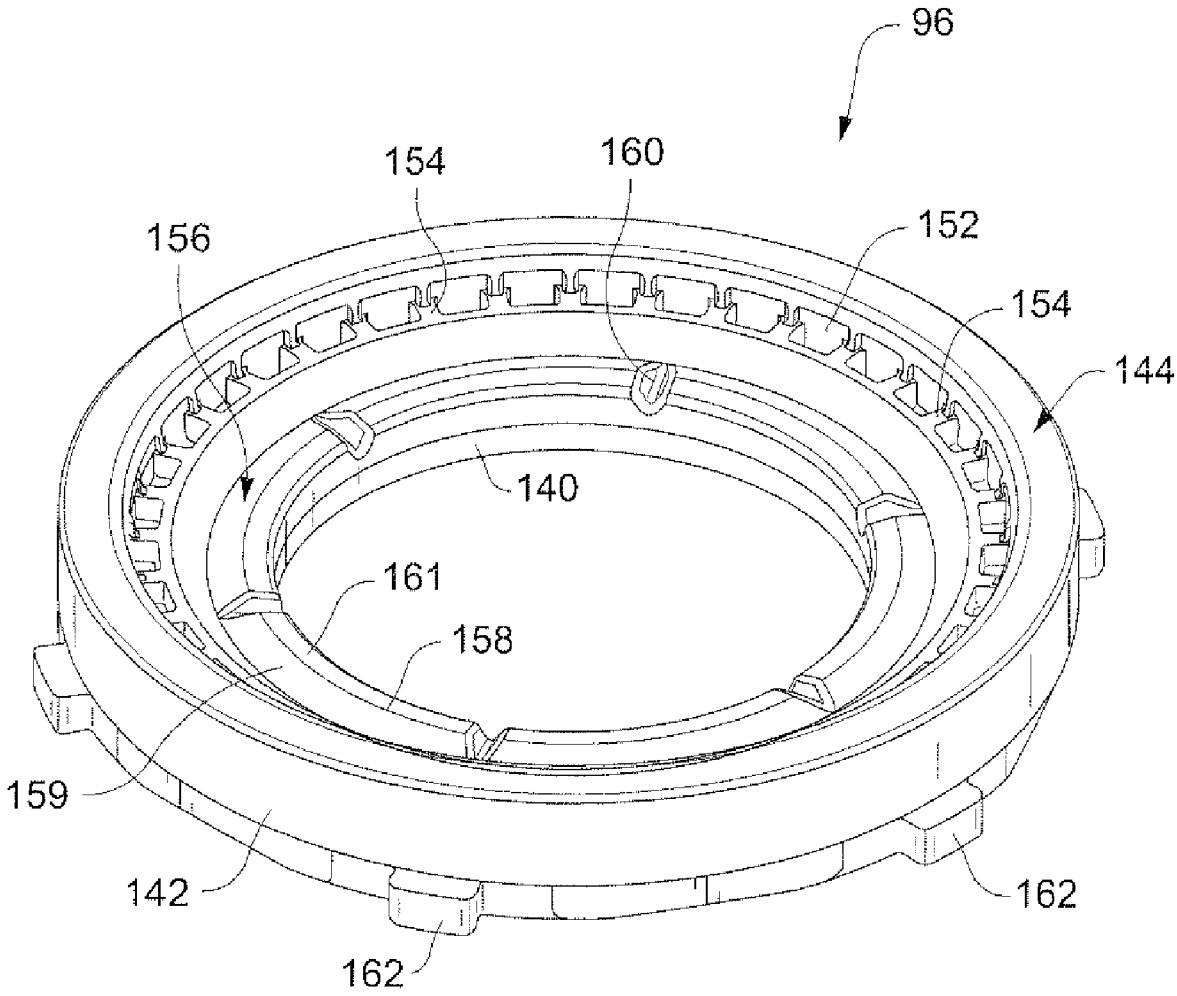
FIG. 7 is an upper perspective view of the race component removed from the sprinkler head shown in FIGS. 1 and 2.
Figure 8:
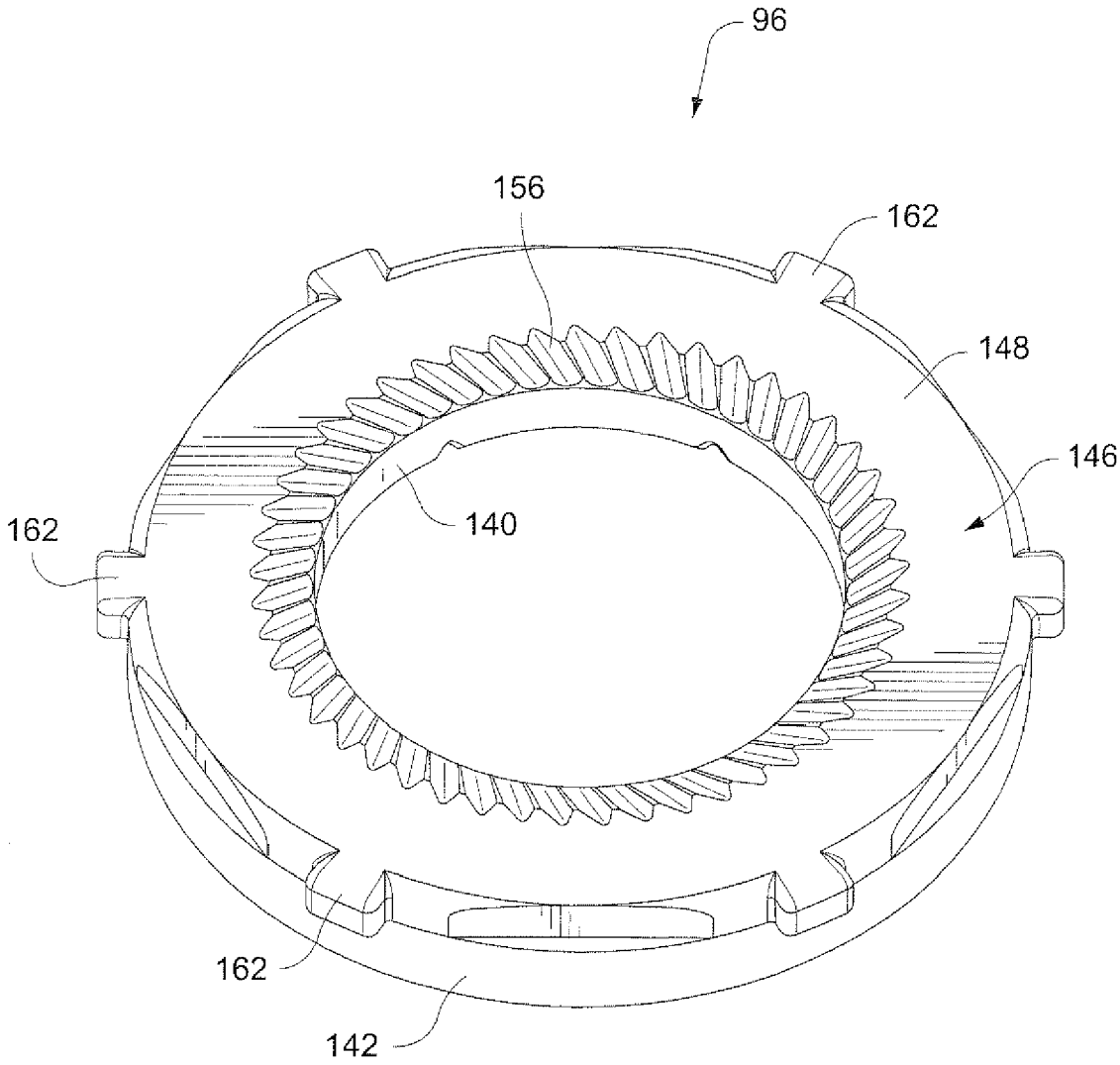
FIG. 8 is a lower perspective view of the race shown in FIG. 7.

The spool assembly 46 in the exemplary embodiment includes an upper spool component 52 and a lower spool component 54 (also separately illustrated in FIGS. 4-6). This split-spool arrangement is employed primarily to facilitate manufacture, but a one-piece spool is not outside the scope of this invention. As best seen in FIGS. 4 and 5, the upper spool component 52 is formed with an upper spool flange 56 joined to a first annular hub portion 58. The upper spool flange 56 includes an underside surface with a concave edge or lip 59, and a radially inner skirt 60. Attached to the inside of the skirt 60 is an annular array of circumferentially-spaced, slotted spring fingers 62. Below the skirt 60 (as viewed in FIG. 4), there is an annular, interior ring or disc 64 that ties together and reinforces the array of spring fingers 62. Located at circumferentially-spaced locations between the spring fingers 62 are a plurality of vertically-extending reinforcing ribs 63 that terminate at their upper ends in the upper spool flange 56, and at their lower ends, below the ring 64 but before the free ends of the spring fingers 62.

The underside 66 of the disc 64 (see FIG. 5) is formed with a pair of downwardly-pointing ("downward" is used in reference to the orientation of the sprinkler in FIGS. 1-3), tapered lugs or "starter buttons" 68, 70 at locations spaced about 150 degrees apart (in one direction, and about 210 degrees apart in the opposite direction) which will cause the spool and water-deflection plate to tilt off-axis when at rest, as described further herein.

FIG. 6 illustrates the lower spool component 54 in greater detail. More particularly, the lower spool component 54 includes a second annular hub portion 72 and a lower spool flange 74. Surrounding the second annular hub portion 72, the lower spool flange 74 is formed with an integral flange or ring 76, an upper shoulder of which is provided with an annular array of upwardly-facing and circumferentially-angled teeth 78, the purpose for which will be described in detail further herein.

From the underside 80 of the lower spool flange, the integral struts 48 extend downwardly and support at their distal ends the water-deflection plate 28 as described above.

Interiorly of the second hub portion 72, there is a plurality of circumferentially-spaced, vertically-oriented ribs 82, each of which includes an upper tapered edge 84, a substantially vertical middle portion 86 and a lower edge 88 radially outwardly offset from the middle portion 86 by a horizontal shoulder 90.

It will be appreciated that the upper and lower spool components 52, 54 can be snapped together, with the middle portions 86 of the ribs 82 received in the slots 92 in the spring fingers 62. In this regard, note the notches 94 formed on the lower outside surface of the spring fingers 62 which facilitate proper alignment with tapered surfaces 84 of the ribs 82 on the lower spool component 54, thus also facilitating assembly of the upper and lower spool components. When fully assembled, the lowermost edges 93 of the slots 92 will engage the shoulders 90 on the ribs 82.

With reference now to FIGS. 2, 3, 7 and 8, sandwiched between upper and lower housing parts of the housing assembly 18, is an annular race 96. The manner in which the race 96 interacts with the upper and lower spool components 52, 54 will be described after the following discussion of the housing assembly 18.

Figure 10:
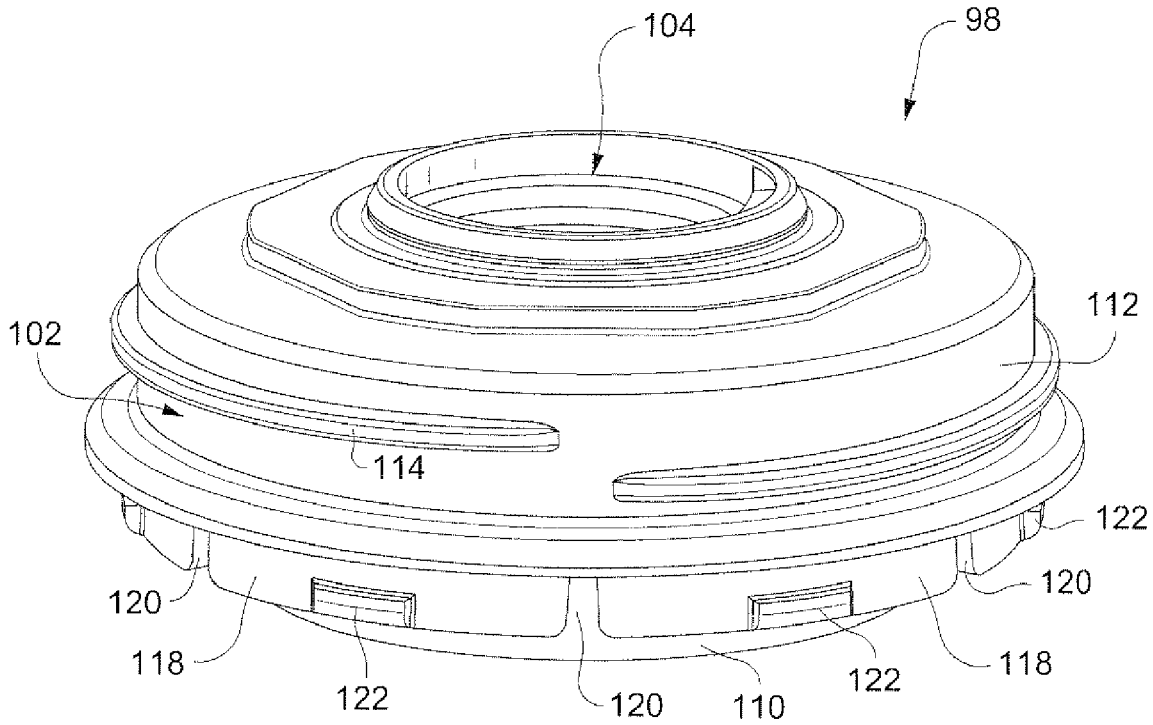
FIG. 10 an upper perspective view of an upper part of the sprinkler housing assembly removed from FIGS. 1 and 2.
Figure 11:
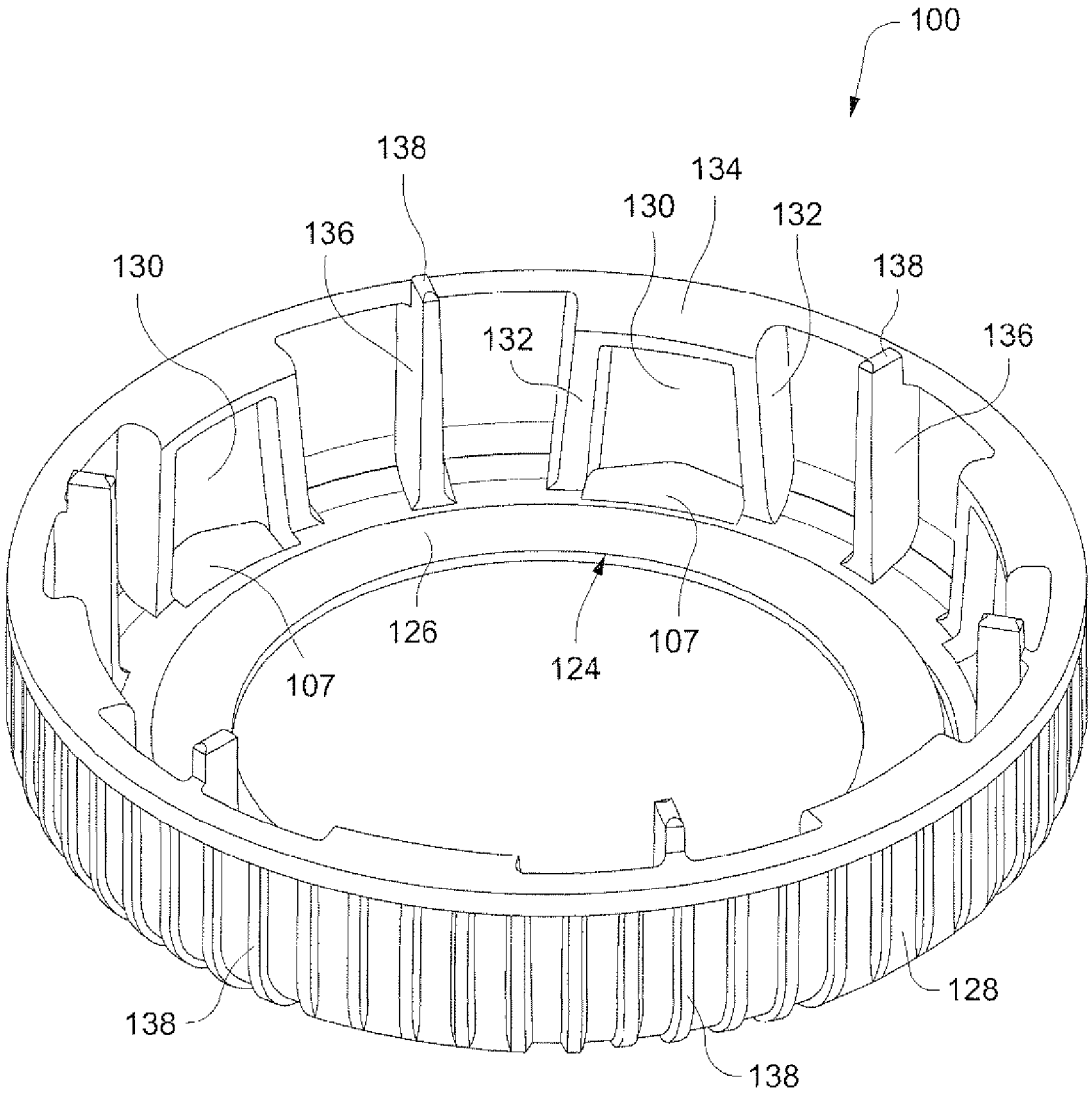
FIG. 11 an upper perspective view of the lower part of the housing assembly.
Figure 12:
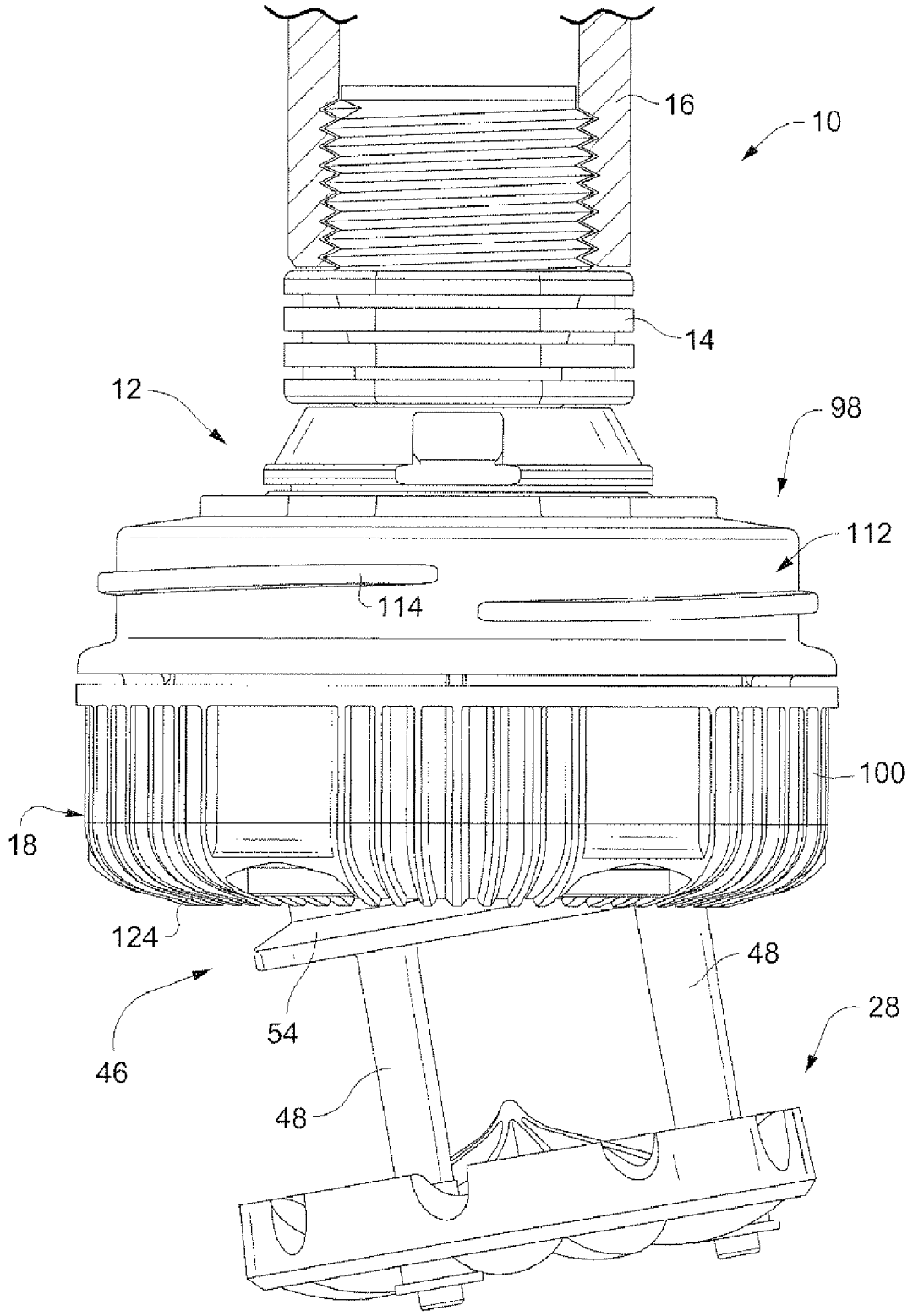
FIG. 12 is a side elevation view similar to FIG. 1 but with the optional weight removed.

With particular attention to FIGS. 2, 10 and 11, the sprinkler housing assembly 18 includes upper and lower parts 98, 100, respectively. The upper housing part 98 includes an outer wall 102 formed at its upper end with a center opening 104 provided with threads 106. Below the threads 106, a radially inner wall 108 tapers inwardly to join with the hub 38. The upper housing part 98 also includes a radially intermediate wall 110 and a radially outer annular skirt or rim 112. The intermediate wall 110 is an annular, solid wall that extends vertically downward a distance greater than the outer annular skirt 112.

As best seen in FIG. 10, the radially outer rim or skirt 112 is formed with a screw thread 114 that enables the sprinkler body to receive an optional donut-shaped weight 116 (see FIG. 9) which will be described further herein. The lower portion of the outer skirt 112 is divided into arcuate segments 118 by a plurality of circumferentially spaced slots 120, each segment having a radially outwardly projecting tab 122 in the center portion of the respective segment.

The lower housing part 100 is formed with a base 124 in the form of a solid annular ring portion 126 and an upwardly projecting side wall 128.

The interior of side wall 128 is formed with circumferentially-spaced pockets or recesses 130 (see FIG. 11), each defined by a pair of inwardly-directed side ribs 132, connected by an inwardly-projecting substantially horizontal rib 134 that is substantially flush with the upper edge of the side wall 128. The spaces between adjacent pockets or recesses 130 are bifurcated by vertical ribs 136 that extend from the base 124 in an upward direction, reduced width portions 138 of which extend beyond the upper edge of the side wall 128. Apertures 107 at the base of pockets or recesses 130 are provided as a manufacturing feature, facilitating the molding of the component.

It will be appreciated that the lower housing part 100 can be secured to the upper housing part 98 by aligning ribs 136 with slots 120, and hence tabs 122 with recesses 130, and pushing the two body parts together, such that the tabs 122 snap over the horizontal ribs 134 into the recesses 130, while allowing the ribs 136 to be fully received within the slots 120. It should be noted that the outer contour of the lower housing part 100 is shaped such that any water running down the outside of the housing 18 will be channeled by external ribs 138 and will otherwise tend to remain attached to the housing especially at the lower end of the lower housing part 100, where the water will flow inwardly along the underside of the base 124 before falling into an area where the emitted streams will carry the excess water radially outwardly with the nozzle streams, thereby minimizing undesirable "drooling" of excess water directly beneath the sprinkler.

With continuing reference to FIGS. 4-8, the annular race 96 is secured between the upper and lower housing parts 98, 100. The race 96 is preferably made of a polyurethane material (for example, a 55D Durometer polyurethane available under the trade name Dow Pellathane®), but other materials may also be suitable. The race 96 is formed with radially inner and outer surfaces 140, 142, respectively and upper and lower surfaces 144, 146, respectively. The flat outer surface portion 148 of the lower surface 146 of the race seats on the opposed annular surface of the solid annular ring portion 126 of the lower housing part 100. An annular groove 152 radially adjacent and below the upper surface 144 of the race is engaged by the lower end of the intermediate wall 110 of the upper body part 98. Groove 152 is formed with a plurality of circumferentially-spaced radially-oriented "crush ribs" 154. A radial inward convex annular rib 156 adjacent the center opening 140 is formed with a raised apex or edge 158 (defined by angled surfaces 159, 161 (FIG. 7) that provides an engagement surface for the upper spool, flange 56 as explained further below. Circumferentially spaced notches 160 in the rib 156 permits drainage of any water that may find its way into the housing assembly.

It will thus be appreciated that, upon assembly of the upper and lower housing parts 98, 100, the race 96 is sandwiched between the intermediate wall 110 of the upper housing part 98 and the ring portion 126 of the lower housing part 100. Note that the "crush ribs" 154 are engageable by the lower end of the wall 110 in a manner that provides a desirable manufacturing tolerance for the assembled parts, without otherwise damaging the race. In other words, some deformation of the ribs 154 due to insufficient tolerances is permitted without affecting the assembly and more importantly the performance of the sprinkler.

Radially inward of the flat outer surface 148 of the lower surface 146 of the race, there is a plurality of upwardly slanted and circumferentially angled and relatively shallow teeth 156. During operation, the teeth 156 are engaged by the teeth 78 on the lower spool component 54 as will be described in greater detail below.

Along the outer periphery and adjacent the lower surface 146 of the race 96, there are a plurality of radially outwardly extending tabs 162 that will engage the ribs 136 on the interior side wall of the lower housing assembly to prevent rotation of the race within the housing part 100 in the event compression of the race by the upper and lower housing parts is insufficient, and rotational creep of the race occurs over time.

With the sprinkler fully assembled, in an at-rest position prior to start-up, the engagement of the starter sleeve 44 with one or both of the lugs or starter buttons 68, 70 on the underside 66 of the spool disc 64 maintains the spool assembly (and hence the water-deflection plate 28) in a tilted or offset position relative to a vertical center axis through the sprinkler head. This tilt insures immediate wobbling or nutating action when the water-deflection plate 28 is impinged upon by a stream under pressure emitted from the nozzle 20. Also in the at-rest position, a point on the undersurface of the upper spool component 52 engages a portion of the apex 158 of the rib 156 on the upper side of the race 96. At this time, the lower flange 74 of the spool is not engaged with the race 96.

During operation, when a stream emitted from the nozzle 20 impinges on the water-deflection plate 28, the plate and the spool 46 will nutate (i.e., wobble and rotate) about the center vertical axis of the sprinkler. During this motion, the underside of the upper flange 56, and specifically the concave lip 59 as defined by inwardly and outwardly facing surfaces 55, 57, respectively, will engage the apex 158 and its adjacent surfaces 159, 161, on the upper side of the race 96, while the teeth 78 on upper side of the lower spool flange 74, will engage the teeth 156 on the lower surface of the race 96 at generally diametrically opposed locations. Note also that after the initial start-up, neither of lugs 68, 70 on the upper spool component disc 64 will be engaged by the starter sleeve flange 42. The outwardly facing surface 57 of the lip 59 is in substantially pure rolling contact with the race, and due to its shallow angle, the inwardly facing surface 55 is also in substantial rolling contact, with minimal sliding contact between any surfaces of the lip 59 and rib 156 on the race 96. With respect to the lower spool flange 74, the engagement of teeth 78 with the teeth 156 on the underside of the race 96 is also substantially rolling contact.

In terms of loading, there is sufficient friction due to vertical load from the water stream that the shallow angled inwardly facing surface 55 on the lip 59 of the upper spool flange can take a high percentage of the side load and yet the assembly is free to tip fully to allow engagement of the spool teeth 78 with the race teeth 156. These teeth are angled slightly so that while providing traction to prevent spinning of the assembly, some of the side load can be taken here as well. By this arrangement, considerably less wear is expected to be experienced by the engaged components during operation of the sprinkler head.

Figure 9:
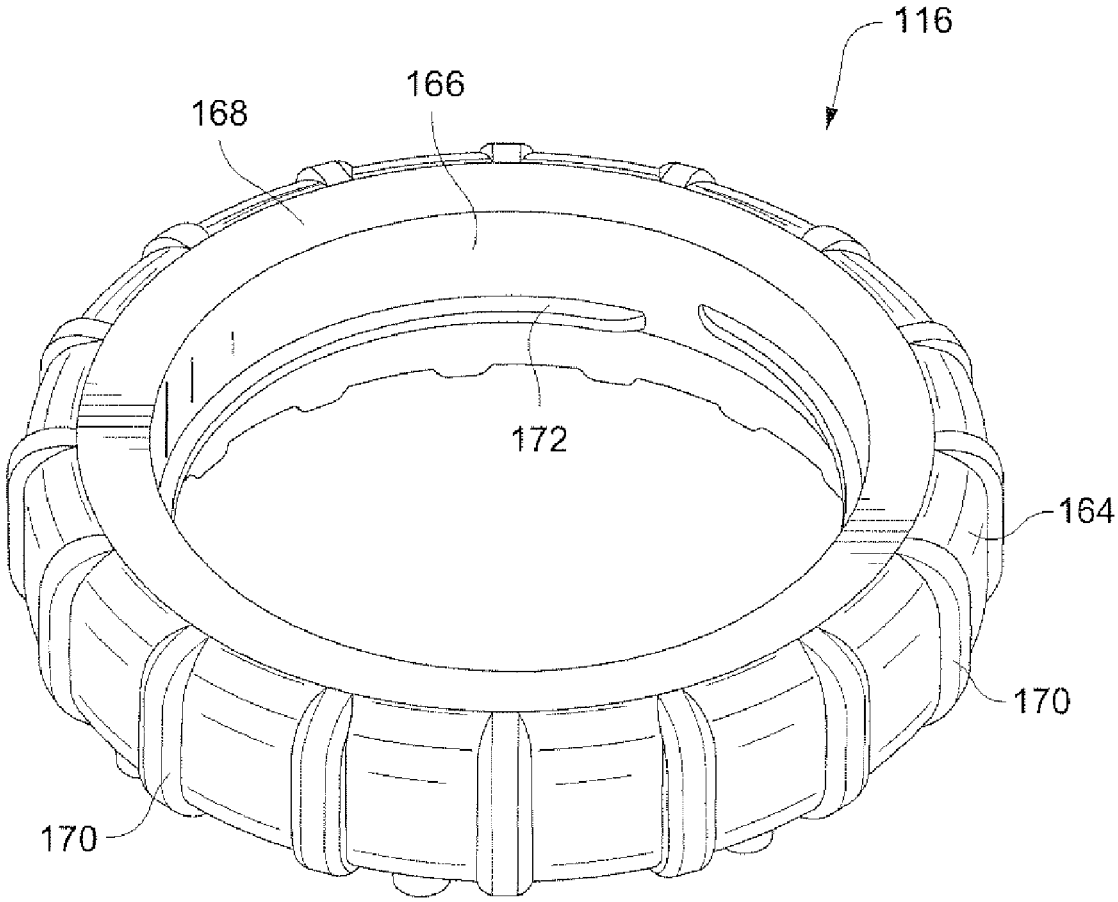
FIG. 9 is a top perspective view of the optional weight component removed from the sprinkler head shown in FIG. 1.

At various times, and under certain weather conditions (e.g., high winds), it may be desirable to add a weight to the sprinkler head to minimize the lateral swinging motion of a flexible drop hose to which the sprinkler head may be attached. FIGS. 1, 2 and 9 illustrate a suitable weight 116 which may be attached to the sprinkler head. With reference to FIG. 9, the weight 116 is substantially donut-shaped, having an outer peripheral wall 164 and an inner peripheral wall 166, joined by a top surface 168. The weight may be of any suitable material, but the presently preferred material is a solid zinc die-casting. The outer peripheral wall 164 may be formed with circumferentially-spaced, vertical ribs 170 which facilitate attachment and detachment of the weight as described further below.

The inner peripheral wall 166 may be formed with attachment features for securing the weight to the sprinkler head. In the illustrated embodiment, the inner surface of the weight is formed with a single screw thread 172 which is adapted to engage a corresponding thread on the exterior of the upper housing part. The thread direction is such that the normal vibratory action of the sprinkler will tend to tighten the weight and thus prevent it from loosening over time.

Other attachment methods may be utilized including, for example, a bayonet-type attachment.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A rotary, nutating sprinkler head comprising:

a housing supporting a nozzle;

a tube axially adjacent said nozzle and extending in a downstream direction, concentric with a vertical center axis of the sprinkler head;

a spool having a hub and upper and lower flanges, said spool loosely supported on said tube, said spool carrying a water-deflection plate formed with one or more grooves shaped to cause said spool and said water-deflection plate to rotate when said water-deflection plate is impinged upon by a stream emitted from said nozzle, said upper flange having an underside formed with a radially outer concave lip, and said lower flange having a topside formed with a first annular array of teeth facing said upper flange;

an annular race supported in said housing, having a radially inner surface defining a center opening; an upper surface having a substantially smooth, radially inner surface portion engageable with said radially outer concave lip of said upper flange, and a lower surface having a surface portion formed with a second annular array of teeth engageable with said first annular array of teeth as said spool rotates and wobbles about said center axis.

2. The sprinkler head of claim 1 wherein said spool is provided with a center disc within said hub, said center disc having a center opening therein through which said tube passes, said tube supporting a starter sleeve engageable by said center disc.

3. The sprinkler head of claim 2 wherein one of said starter sleeve and said center disc is provided with at least one tilting lug located to maintain said spool in a tilted or angularly offset orientation relative to said vertical center axis, thereby facilitating a wobbling action of said spool assembly during rotation.

4. The sprinkler head of claim 3 wherein said at least one tilting lug is provided on said center disc.

5. The sprinkler head of claim 4 wherein said at least one starter lug comprises a pair of starter lugs circumferentially spaced from each other by about 150 degrees in one circumferential direction.

6. The sprinkler head of claim 3 wherein said housing comprises upper and lower housing components, said upper component formed with a radially inner wall incorporating a collar portion adapted for coupling to another component, wherein said nozzle is sandwiched between said another component and said upper housing component, and wherein said tube is carried by said radially inner wall downstream of said nozzle.

7. The sprinkler head of claim 6 wherein said annular race is supported axially between said upper and lower housing components.

8. The sprinkler head of claim 7 wherein said upper surface of said annular race is formed with an annular groove adapted to be engaged by an annular intermediate wall of said upper housing component, and wherein the lower surface of said race is seated on a base of said lower housing component.

9. The sprinkler head of claim 8 wherein said spool is comprised of upper and lower components telescoped together at said hub.

10. The sprinkler head of claim 3 wherein said race is constructed of polyurethane.

11. The sprinkler head of claim 1 wherein said water-deflection plate is supported from said spool by a plurality of struts.

12. The sprinkler head of claim 1 and further comprising a weight, said sprinkler head and said weight provided with complimentary means for enabling quick connect/disconnect of said weight to and from said sprinkler head.

13. The sprinkler head of claim 12 wherein said weight is attached to said sprinkler head by a threaded connection such that vibrations in said sprinkler head during use will tend to tighten the connection.

14. A rotary, nutating sprinkler head comprising:

a housing supporting a nozzle;

a tube axially adjacent said nozzle and extending in a downstream direction, concentric with a vertical center axis of the sprinkler head;

a double-flanged spool loosely supported on said tube, said spool carrying a water-deflection plate, said water-deflection plate formed with one or more grooves shaped to cause said spool to rotate when impinged upon by a stream emitted from said nozzle; and an annular race supported in said housing having upper and lower surfaces engageable via substantially rolling contact with portions of said upper and lower flanges, respectively, of said spool as said spool rotates and wobbles about said center axis.

15. The sprinkler head of claim 14 wherein said upper surface of annular race engageable with said upper flange includes an annular upwardly convex rib having an apex, and wherein said upper flange of said spool is formed with a concave edge portion engageable with said convex rib.

16. The sprinkler head of claim 15 wherein a radially inner portion of said lower surface of said race is formed with a first annular array of teeth angularly oriented in a circumferential direction, and said lower flange is formed with a second annular array of complimentary teeth engageable with said first annular array of teeth.

17. The sprinkler head of claim 16 wherein said race is constructed of polyurethane.

18. The sprinkler head of claim 14 and further comprising a weight, said sprinkler head and said weight provided with complimentary means for enabling quick connect/disconnect of said weight to and from said sprinkler head.

19. The sprinkler head of claim 14 wherein one of said tube and said spool is provided with at least one tilting lug located to keep said spool assembly in a tilted or angularly offset orientation relative to said vertical center axis, thereby facilitating a wobbling action of said spool assembly during rotation.

* * * * *